US009903647B2

(12) United States Patent
Scott et al.

(10) Patent No.: US 9,903,647 B2
(45) **Date of Patent: *Feb. 27, 2018**

(54) SYSTEMS AND METHODS FOR FLOATING DOCKSIDE LIQUEFACTION OF NATURAL GAS

(71) Applicant: EXCELERATE LIQUEFACTION SOLUTIONS, LLC, The Woodlands, TX (US)

(72) Inventors: Edward Scott, Spring, TX (US); Thomas M. Norton, Everglades City, FL (US); Michael Anthony Watzak, Magnolia, TX (US); Kenneth Hugh McGeachie, Spring, TX (US); Robert Tylor Olsen, Katy, TX (US); Martin A. Hruska, The Woodlands, TX (US)

(73) Assignee: EXCELERATE LIQUEFACTION SOLUTIONS, LLC, The Woodlands, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/283,009

(22) Filed: Sep. 30, 2016

(65) Prior Publication Data

US 2017/0016666 A1 Jan. 19, 2017

Related U.S. Application Data

(63) Continuation of application No. 14/779,701, filed as application No. PCT/US2014/033072 on Apr. 4, 2014, now Pat. No. 9,493,216.

(Continued)

(51) Int. Cl.

*B63B 35/44* (2006.01)
*F25J 1/00* (2006.01)

(Continued)

(52) U.S. Cl.

CPC ..... *F25J 1/0022* (2013.01); *B63B 27/34* (2013.01); *B63B 35/44* (2013.01); *F17C 9/00* (2013.01);

(Continued)

(58) Field of Classification Search

CPC ..... F25J 1/0022; F25J 1/0259; F25J 1/0269; F25J 1/0278; B63B 27/34; B63B 35/44

See application file for complete search history.

(56) References Cited

U.S. PATENT DOCUMENTS 4,217,848 A * 8/1980 Meyer-Haake ..... B63B 9/065 114/264
4,408,943 A 10/1983 McTamaney et al.
8,375,875 B2 2/2013 Kim et al.

FOREIGN PATENT DOCUMENTS

CN 101490490 A 7/2009
CN 101787314 A 7/2010

(Continued)

OTHER PUBLICATIONS

IP Australia, "Patent Examination Report No. 1" for Australia Patent Application No. 2014251176, dated Aug. 19, 2016, 2 pages.

(Continued)

*Primary Examiner* — Stephen P Avila
(74) *Attorney, Agent, or Firm* — Frederic Dorwart, Lawyers PLLC; Penina Michlin Chiu

(57) ABSTRACT

System and methods for floating dockside liquefaction of natural gas are described. A system for floating dockside liquefaction of natural gas comprises a natural gas pretreatment facility located onshore proximate a dock, wherein the natural gas pretreatment facility is configured to process pipeline quality gas into pretreated natural gas, a floating liquefaction unit moored at the dock, wherein the floating liquefaction unit further comprises a natural gas liquefaction module on a deck, and an LNG storage tank for storing (Continued)

produced LNG below the deck, a pipeline coupling the onshore pretreatment facility to the dock, wherein the pipeline is configured to transport pretreated natural gas onto the dock, and a high pressure gas arm fluidly coupling the pipeline to the floating liquefaction unit, wherein the gas arm is configured to transfer pretreated natural gas to the floating liquefaction unit.

20 Claims, 5 Drawing Sheets

Related U.S. Application Data

(60) Provisional application No. 61/811,713, filed on Apr. 13, 2013, provisional application No. 61/811,295, filed on Apr. 12, 2013.

(51) Int. Cl.
*B63B 27/34* (2006.01)
*F17C 9/00* (2006.01)
*F25J 1/02* (2006.01)

(52) U.S. Cl.
CPC ..... *F25J 1/0259* (2013.01); *F25J 1/0269* (2013.01); *F25J 1/0278* (2013.01); *B63B 2035/4473* (2013.01); *F25J 2290/60* (2013.01)

(56) References Cited

FOREIGN PATENT DOCUMENTS

| | | | |
|---|---|---|---|
| CN | 101965290 | A | 2/2011 |
| CN | 102959351 | A | 3/2013 |
| JP | 2012083051 | A | 10/2013 |
| KR | 1012460760000 | B1 | 3/2013 |
| WO | 2010036121 | A2 | 4/2010 |

OTHER PUBLICATIONS

The State Intellectual Property Office of China "Office Action" for China Patent Application No. 201480020746.7, dated Dec. 19, 2016, 10 pages.

IP Australia, "Notice of grant for patent" for Australia Patent Application No. 2014251176, dated Feb. 9, 2017, 1 page.

European Patent Office, "Invitation pursuant to Rule 63(1) EPC", dated Dec. 21, 2016, 3 pages.

European Patent Office, "Supplementary European Search Report" for EP Application No. 14783005.3 dated Jun. 22, 2017, 14 pages.

Intellectual Property Office of Singapore, "Supplementary Examination Report" for Singapore Patent Application No. 11201507299T, dated Feb. 20, 2017, 1 page.

Intellectual Property Office of Singapore, "Notice of Eligibility for Grant" for Singapore Patent Application No. 11201507299T, dated Mar. 2, 2017, 1 page.

"Notice of Non-Final Rejection" regarding Korean Patent Application No. 10-2015-7030346, dated Apr. 20, 2017, 11 pages.

Translation by James Cleeve, "English Translation of the State Intellectual Property Office of China "Office Action" for China Patent Application No. 201480020746.7", translation dated Jan. 24, 2017, 14 pages.

* cited by examiner

SYSTEMS AND METHODS FOR FLOATING DOCKSIDE LIQUEFACTION OF NATURAL GAS

CROSS REFERENCE TO RELATED APPLICATIONS

This application is a continuation of U.S. application Ser. No. 14/779,701 to Scott et al., filed Sep. 24, 2015 and entitled "SYSTEMS AND METHODS FOR FLOATING DOCKSIDE LIQUEFACTION OF NATURAL GAS," which is a U.S. national phase entry of PCT/US2014/033072 filed Apr. 4, 2014, which claims the benefit of U.S. Provisional Application No. 61/811,713 to Scott et al., filed Apr. 13, 2013 and entitled "SYSTEM AND METHOD FOR FLOATING DOCKSIDE LIQUEFACTION OF NATURAL GAS," and also claims the benefit of U.S. Provisional Application No. 61/811,295 to Scott et al., filed Apr. 12, 2013 and entitled "SYSTEM AND METHOD FOR FLOATING DOCKSIDE LIQUEFACTION OF NATURAL GAS," which are each hereby incorporated by reference in their entireties.

BACKGROUND OF THE INVENTION

1. Field of the Invention

Embodiments of the invention described herein pertain to the field of liquefaction of natural gas. More particularly, but not by way of limitation, one or more embodiments of the invention describe systems and methods for the dockside liquefaction of natural gas on a floating unit.

2. Description of the Related Art

Natural gas is typically transported by pipeline from the location where it is produced to the location where it is consumed. However, large quantities of natural gas may sometimes be produced in an area or country where production far exceeds demand, and it may not be feasible to transport the gas by pipeline to the location of commercial demand, for example because the location of production and the location of demand are separated by an ocean or rain forest. Without an effective way to transport the natural gas to a location where there is a commercial demand, opportunities to monetize the gas may be lost.

Liquefaction of natural gas facilitates storage and transportation of the natural gas. Liquefied natural gas ("LNG") takes up only about 1/600 of the volume that the same amount of natural gas does in its gaseous state. LNG is produced by cooling natural gas below its boiling point (−259° F. at atmospheric pressure). LNG may be stored in cryogenic containers slightly above atmospheric pressure. By raising the temperature of the LNG, it may be converted back to its gaseous form.

The demand for natural gas has stimulated the transportation of LNG by special vessels. Natural gas produced in locations where it is abundant, may be liquefied and shipped overseas in this manner to locations where it is most needed. Typically, the natural gas is gathered through one or more pipelines to a land-based liquefaction facility. Land-based liquefaction facilities and the associated gathering pipelines are costly, may occupy large areas of land and take several years to permit and construct. Thus, land-based facilities are not optimally suited to adapt to variation in the location of natural gas supplies or to liquefy small or stranded gas reserves. In addition, once natural gas is liquefied at a land based facility, the LNG must be stored in large land-based cryogenic storage tanks, transported through a special cryogenic pipeline to a terminal facility, and then loaded onto a vessel equipped with cryogenic compartments (such a vessel may be referred to as an LNG carrier or "LNGC"), which in combination may increase the overall expense of transporting the gas to its ultimate destination.

In some instances, natural gas deposits may be found in underwater gas fields located in the open ocean, such as locations more than 100 miles to the nearest land. In such situations it has been proposed that natural gas be liquefied on large offshore floating platforms that are turret moored or spread moored to the bottom of the sea, and located above the well head in the open ocean. These floating liquefaction vessels are large in size, typically about 450 or 500 meters from stern to bow, since they must be fully-integrated, self-contained gas processing and LNG production facilities: all gas processing, liquefaction equipment, cooling systems, condensate storage and waste storage must be included onboard. Such arrangements are costly due to the size of the facilities, the difficulties of working in the open ocean, and extensive subsea infrastructure requirements in order to extract the gas and transfer it to the offshore platform or vessel in order to be liquefied and transported. Therefore, this offshore, fully-integrated approach is often not practical or economical for use with small or stranded natural gas reserves located offshore, reserves located near shore, or on land reserves.

Conventional techniques for liquefying natural gas are not well suited for small or stranded natural gas reserves located offshore, natural gas reserves located near shore, or on land natural gas reserves, as they are not cost effective and are slow to market. Therefore, there is a need for systems and methods for floating dockside liquefaction of natural gas.

BRIEF SUMMARY OF THE INVENTION

One or more embodiments of the invention describe systems and methods for floating dockside liquefaction of natural gas. A system for floating dockside liquefaction of natural gas of an illustrative embodiment comprises a natural gas pretreatment facility located onshore proximate a dock, wherein the onshore natural gas pretreatment facility is configured to process pipeline quality gas into pretreated natural gas, a floating liquefaction unit moored at the dock, wherein the floating liquefaction unit further comprises a natural gas liquefaction module on a deck, and an LNG storage tank for storing produced LNG below the deck, a pipeline coupling the onshore pretreatment facility to the dock, wherein the pipeline is configured to transport pretreated natural gas onto the dock, and a high pressure gas arm fluidly coupling the pipeline to the floating liquefaction unit, wherein the gas arm is configured to transfer pretreated natural gas to the floating liquefaction unit. In some embodiments, the pretreated natural gas is near-LNG quality and the floating liquefaction unit further comprises a final gas processing unit onboard configured to bring the near-LNG quality natural gas to LNG quality prior to liquefaction. In some embodiments, the onshore pretreatment facility further comprises a closed loop cooling system configured to cool equipment onboard the floating liquefaction unit. In certain embodiments, the system further comprises a gas conduit configured to transport pipeline quality natural gas to the onshore pretreatment facility. In some embodiments, the gas conduit is coupled to an offshore gas reserve. In some embodiments, the gas conduit is coupled to an onshore gas reserve.

A system for floating dockside liquefaction of natural gas of an illustrative embodiment comprises a floating liquefaction unit moored at a sea island, wherein the floating liquefaction unit further comprises a natural gas liquefaction module on a deck, and an LNG storage tank for storing produced LNG below the deck, a natural gas pretreatment facility located onshore proximate the sea island, a pipeline extending at least partially below the surface of a water and configured to transfer pretreated natural gas from the onshore pretreatment facility to the dock, and a natural gas conduit configured to deliver pipeline quality natural gas to the onshore pretreatment facility. In some embodiments, the pipeline is at least partially on the sea island. In some embodiments, a cryogenic hard arm couples the floating liquefaction unit with an LNG carrier and is configured to transfer LNG to the LNG carrier. In some embodiments, the sea island is in water less than 65 feet deep. In some embodiments, the onshore pretreatment facility further comprises a closed loop cooling system configured to cool equipment onboard the floating liquefaction unit.

A method for floating dockside liquefaction of natural gas of an illustrative embodiment comprises pretreating natural gas for shipboard liquefaction at an onshore pretreatment facility proximate a dock, transporting the pretreated natural gas by pipeline from the onshore pretreatment facility to a floating liquefaction unit moored at the dock, liquefying the natural gas onboard the floating liquefaction unit to form LNG, storing the LNG onboard the floating liquefaction unit, and transferring the LNG from the floating liquefaction unit to a receiving LNG carrier for transport to the location of use. In some embodiments, up to about five million tons per annum of natural gas are liquefied onboard the floating liquefaction unit. In some embodiments, the LNG is transferred from the floating liquefaction unit to a receiving LNG carrier using side-by-side ship-to-ship transfer. In some embodiments, the floating liquefaction unit is moored at the dock with mooring lines to deadman anchors located onshore. In some embodiments, the method further comprises the steps of completing construction of the floating liquefaction unit at a shipyard and transporting the fully constructed unit from the shipyard to the dock. In some embodiments the dock is a sea island and the natural gas is transported to the floating liquefaction unit at least partially beneath the surface of water and at least partially on the sea island. In some embodiments, the method further comprises the step of cooling liquefaction systems onboard the floating liquefaction unit using shore-based water.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

The above and other aspects, features and advantages of illustrative embodiments of the invention will be more apparent from the following more particular description thereof, presented in conjunction with the following drawings wherein.

Figure 1A:
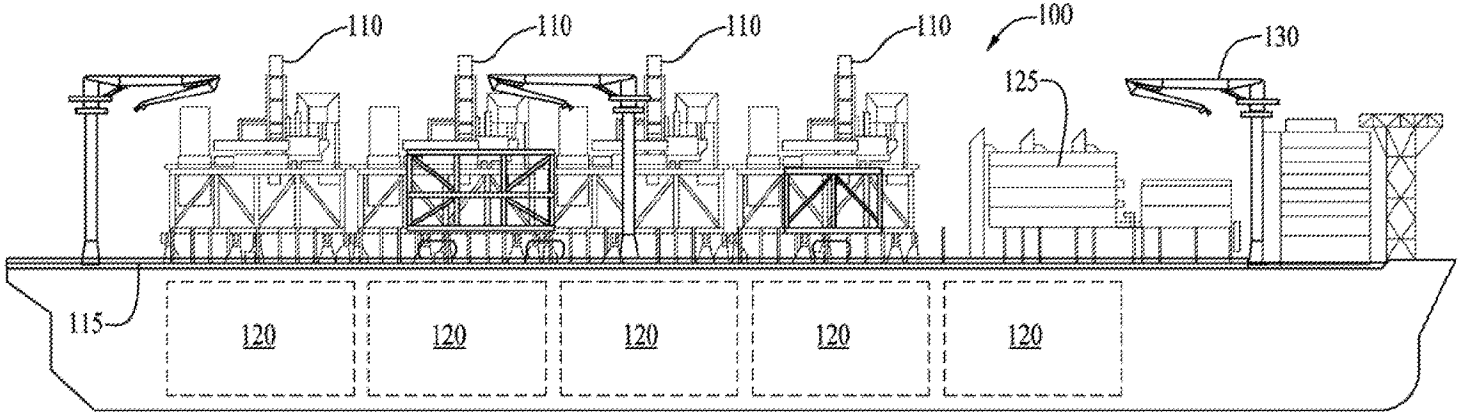
FIG. 1A illustrates a schematic of a profile view of a floating liquefaction unit of an illustrative embodiment.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

Systems and methods for floating dockside liquefaction of natural gas will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a liquefaction module includes one or more liquefaction modules.

"Coupled" refers to either a direct connection or an indirect connection (e.g., at least one intervening connection) between one or more objects or components. The phrase "directly attached" means a direct connection between objects or components.

As used in this specification and the appended claims, "or" is used to mean "and/or" unless explicitly indicated to refer to alternatives only or the alternatives are mutually exclusive.

As used in this specification and the appended claims, "high pressure" means the pressure of a gas at pipeline pressure. Thus, for example, with respect to natural gas being transported to a floating liquefaction unit for liquefaction, "high pressure" means about 50-100 bar.

"Dock" refers to a structure to which a vessel (floating unit) may be moored and extending into a sea, lake, river or other navigable body of water. As used herein, a "dock" is a fixed mooring structure having a static connection to the sea, lake or river bed (floor). A "dock" may include a platform on the surface of the water and extending alongshore or extending out from the shore, or may be a "sea island" with a platform that is not connected to the shore on the water's surface. A "dock," as used herein, does not include unfixed mooring structures such as turret mooring or spread mooring facilities.

As used herein, a "sea island" refers to a type of dock with a platform on the surface of the water that is not connected to shore on the water's surface, but which may be connected to shore by an underwater (subsea) conduit.

As used herein, "pretreated gas" refers to natural gas that is near-LNG quality or LNG quality. "LNG quality" refers to gas that is in condition to be liquefied and/or has had lighter components which tend to freeze removed. As used herein "pipeline quality" refers gas that has been treated for transport on a natural gas pipeline, but has not yet been pretreated for liquefaction. "Pretreatment" of gas refers to bringing pipeline quality natural gas to near-LNG quality or LNG quality.

One or more embodiments of the invention provide systems and methods for floating dockside liquefaction of natural gas. While for illustration purposes the invention is described in terms of natural gas, nothing herein is intended to limit the invention to that embodiment. The invention may be equally applicable to other hydrocarbon gases which may be transported as liquids, for example petroleum gas. While for illustration purposes the invention is described in terms of the ocean, nothing herein is intended to limit the invention to that embodiment. The invention may be equally applicable to other navigable bodies of water, for example a river or lake.

The invention disclosed herein includes systems and methods for floating dockside liquefaction of natural gas. Illustrative embodiments provide for efficient bifurcation of natural gas processing, treatment and liquefaction systems between onshore and offshore facilities, in order to improve the economic feasibility of accessing small or stranded gas reserves. A floating liquefaction and storage unit may moored at a dock and may include a natural gas liquefaction module on deck and LNG storage in tanks below the deck, for example in the hull. A natural gas pretreatment facility may be located onshore proximate the dock. In such embodiments, natural gas may be pretreated for liquefaction at the onshore pretreatment facility and then transported by pipeline to the floating liquefaction unit for liquefaction. Onshore pretreatment facilities to be used in conjunction with a floating liquefaction unit may allow for a more compact floating liquefaction unit and/or allow for additional liquefaction modules to be accommodated on the deck than would otherwise be possible, increasing the liquefaction capacity of the unit whilst minimizing the civil footprint of illustrative embodiments. In an alternative embodiment, natural gas may be pretreated for liquefaction onboard the floating liquefaction unit, for example in instances where onshore pretreatment is not possible or desirable.

Illustrative embodiments provide an effective solution at minimal cost as compared to conventional liquefaction approaches, such as onshore liquefaction or unbifurcated, fully-integrated and self-contained offshore gas processing and LNG production facilities, such as those making use of turret mooring or spread mooring systems. Illustrative embodiments significantly reduce the civil footprint and/or minimize the need for fixed infrastructure of the liquefaction facilities as compared to conventional liquefaction approaches. Illustrative embodiments of an exemplary floating liquefaction unit may be built, including the installation of all liquefaction train(s), in the controlled environment of a shipyard, and thus may be brought to market faster and more efficiently than conventional liquefaction facilities, contributing to a higher degree of quality on a tighter schedule. Construction of a floating liquefaction unit at a shipyard may provide for a specialized construction labor pool and construction materials to be located in a single, convenient and controlled location. The systems and methods described herein provide a cost effective, faster and more efficient option to liquefy natural gas than conventional LNG production facilities. In some embodiments, the systems and methods of the invention may produce LNG in as little as about 44 months from a final investment decision (for units capable of producing up to 5 million tons per annum of LNG) at a fraction of the cost of comparable conventional LNG production facilities, depending on the nature and location of the gas.

Illustrative embodiments implement a closed-loop cooling system, reducing environmental impact as compared to fully-integrated, offshore liquefaction approaches that employ seawater for cooling. Conventional offshore, fully-integrated liquefaction facilities may draw millions of liters of water from the ocean every hour for purposes of cooling associated equipment, after which the warmer water is discharged back into the ocean. This increases the temperature of the water surrounding the offshore liquefaction facility, which may have a negative environmental impact on surrounding organisms (sea life).

Figure 1B:
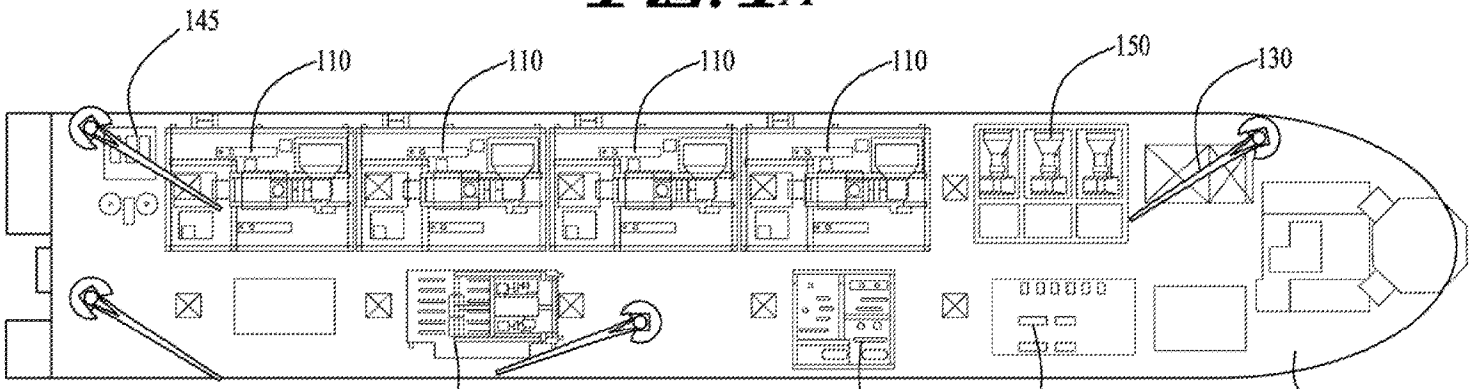
FIG. 1B illustrates a schematic of a plan view of a deck of a floating liquefaction unit of an illustrative embodiment.
Figure 1C:
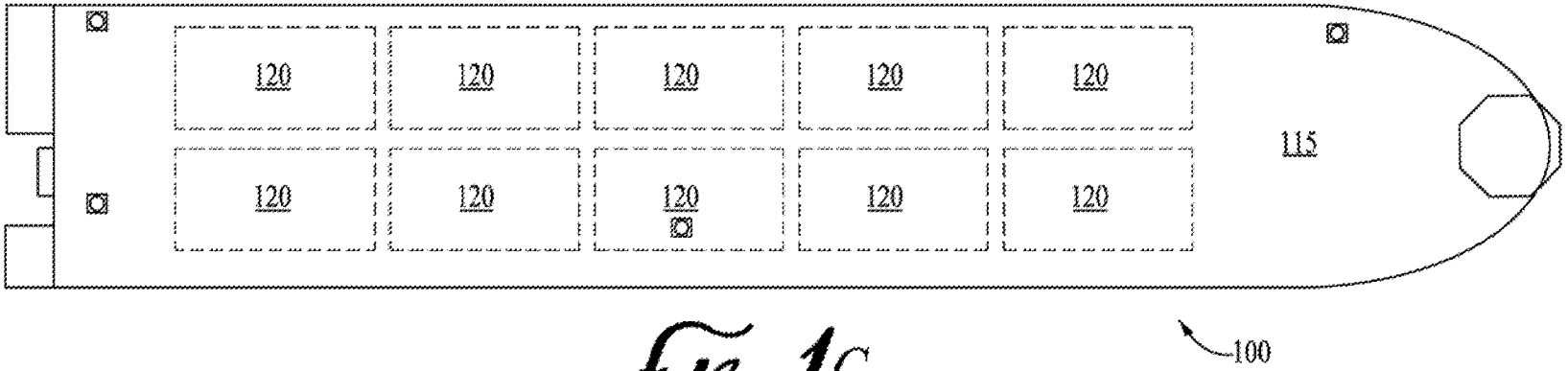
FIG. 1C illustrates a schematic of a plan view of a hull and LNG storage tank arrangement of a floating liquefaction unit of an illustrative embodiment.

FIGS. 1A-1C illustrate an exemplary floating liquefaction unit for use in the system of an illustrative embodiment. In some embodiments, floating liquefaction unit 100 may be a floating liquefaction storage and offloading unit. In some embodiments, floating liquefaction unit 100 may not be capable of self-propulsion, while in other embodiments self-propulsion may be included.

Floating liquefaction unit 100 may include a liquefaction train including liquefaction module 110. An example of liquefaction module 110 includes, but is not limited to, liquefaction systems provided by Black & Veatch Corporation of Overland Park, Kans., United States, Air Products and Chemicals, Inc. of Allentown, Pa. or CB&I Lummus of The Hague, Netherlands. Preferably, liquefaction module 110 is selected to have a reduced equipment count, a smaller, more compact footprint, and is simpler to operate than land-based or fully integrated offshore liquefaction modules. Liquefaction module 110 may accommodate a broad range of gas-quality specifications. Liquefaction module 110 may be located on deck 115 or other location onboard floating liquefaction unit 100. Floating liquefaction unit 100 may include one, two, three, four or more liquefaction trains 110. As shown in FIGS. 1A, 1B floating liquefaction unit 100 may include four liquefaction modules 110, each having about one million tons per annum (MTPA) processing capacity. In some embodiments, limiting the number of liquefaction modules 110 to four or less and/or locating gas pretreatment facilities onshore provides for reduced equipment count and a smaller, more compact floating liquefaction unit 100 that is simpler to construct, operate and more readily positioned near the desired natural gas reserves.

Floating liquefaction unit 100 may also include cryogenic LNG storage tank 120. LNG storage tank 120 may be a membrane, self-supporting prismatic or self-supporting spherical type cargo tank. In some embodiments, the LNG containment system for the floating liquefaction unit storage tanks may be a membrane design in a two row/ten tank configuration to minimize sloshing and provide mid-span deck support for installed liquefaction train(s). As shown in FIG. 1C, ten membrane LNG storage tanks 120 may be utilized in a side-by-side configuration. In some embodiments, floating liquefaction unit 100 may be capable of storing about 173,000 m3 up to about 250,000 m3 of LNG and about 35,000 m3 of condensate if required.

Floating liquefaction unit 100 may also include boil-off gas system 140 to handle natural boil-off of the LNG from LNG storage tank 120. In some embodiments, boil-off gas may be used as fuel for liquefaction module 110, power generation system 150 and/or a propulsion system (not shown) onboard floating liquefaction unit 100. Floating liquefaction unit 100 may also include onboard fractionation system 135 for the removal of heavier hydrocarbons, refrigerant make-up system 145, inert gas/dry air system to provide inert gas and/or dry air to LNG storage tank 120 as part of gas freeing operations for inspection and/or maintenance, a nitrogen system to purge LNG piping, control room 125, LNG unloading arms such as hose 325 (shown in FIGS. 2A and 2B), high pressure gas loading arms such as gas arm 330 (shown in FIGS. 2A and 2B), accommodations for the facility workers, fixed crane 130, power generation system 150 and/or other such equipment as is well known to those of skill in the art. In some embodiments, one, some or all of the above listed elements may be located at onshore pretreatment facility 280 (shown in FIGS. 2A and 2B).

Figure 2A:
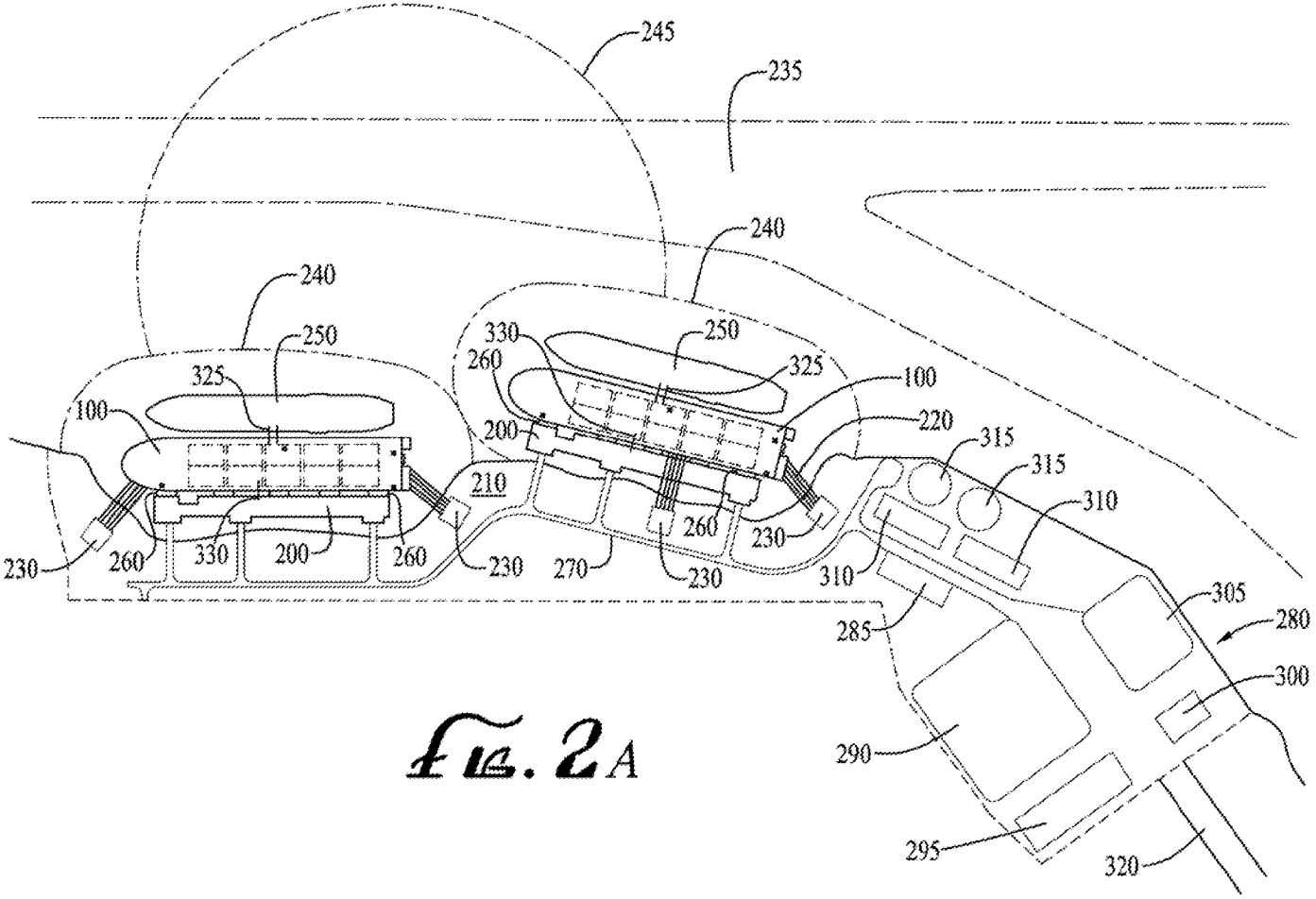
FIG. 2A illustrates a schematic of a system for onshore pretreatment and floating dockside liquefaction of natural gas of an illustrative embodiment.
Figure 2B:
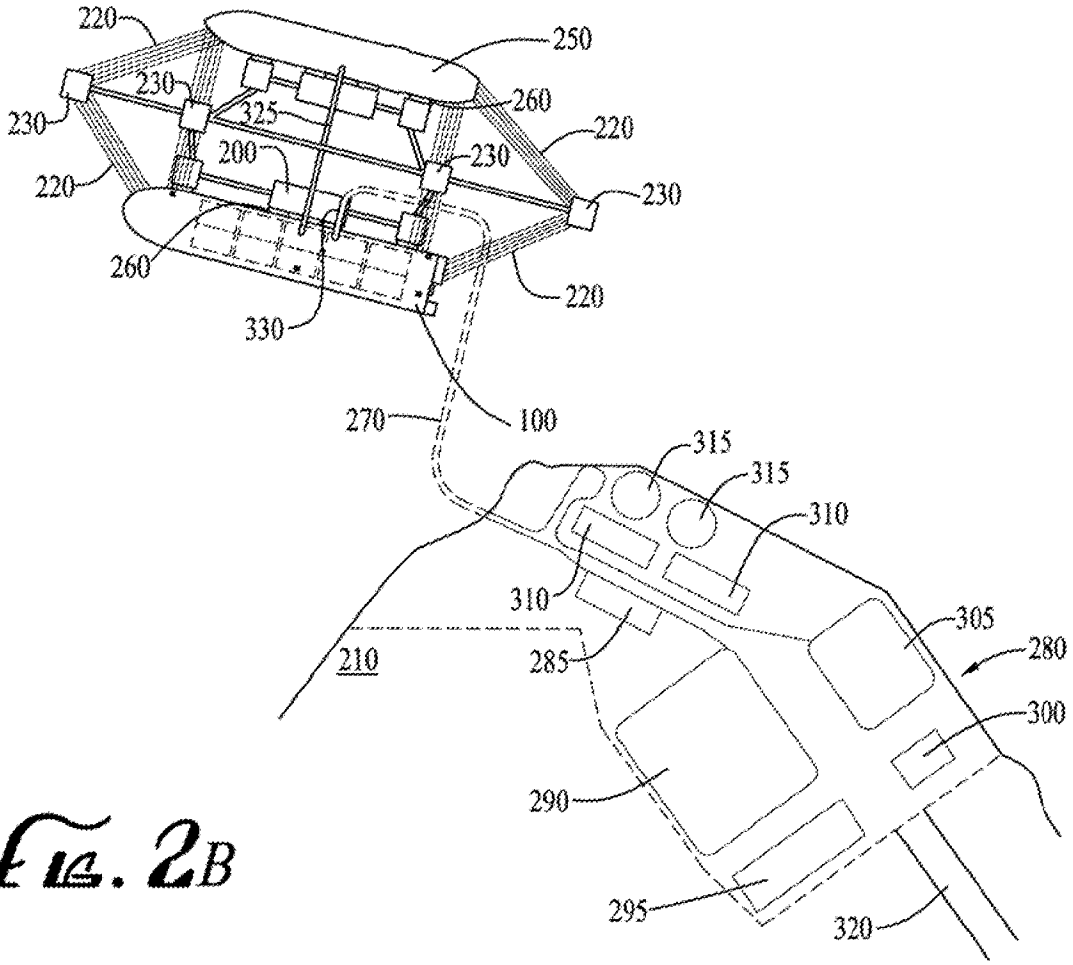
FIG. 2B illustrates a schematic of a system for onshore pretreatment and floating dockside liquefaction of natural gas of an illustrative embodiment.

Gas process area 290, hydrocarbon storage area 285, waste water treatment area 295, cooling water heat exchangers 310, natural gas receiving area 305 and/or water storage tanks 315 may be onshore as illustrated in FIGS. 2A and 2B. Placing these facilities onshore, rather than onboard floating liquefaction unit 100, may reduce the density and size of the equipment located onboard floating liquefaction unit 100, which allows floating liquefaction unit 100 to be lighter, smaller and/or have greater liquefaction capacity, for example 25% more liquefaction capacity than if pretreatment facilities were onboard the unit. Placing equipment onshore may also reduce the need to construct steel structures around the equipment for protection. Cooling water heat exchangers 310 may comprise a closed-loop cooling system for cooling liquefaction machine drivers and/or other equipment onboard floating liquefaction unit that require cooling. Onshore cooling water heat exchangers 310 may include flexible connections to the aft and/or forward of floating liquefaction unit 100. Onshore cooling water heat exchangers 310 may employ a closed-loop, flexible cooling system that does not use surrounding sea water for cooling, and thus reduces the environmental impact of the facilities since the temperature of the sea water is not raised during cooling operations. For example, water from shore may be employed, rather than the surrounding seawater as is used by fully-integrated offshore liquefaction facilities. In alternative embodiments, one, some or all of the elements of onshore pretreatment facilities 280 may be located onboard floating liquefaction unit 100.

FIGS. 2A-2B show schematics of illustrative embodiments of systems for floating dockside liquefaction of natural gas. In some embodiments, dock 200 may extend from, extend along, be attached to and/or proximate to shoreline 210. In some embodiments, dock 200 may be any structure that extends from about shoreline 210 into a navigable body of water. In some embodiments, dock 200 may not be attached to shoreline 210 on the surface of the water, but may be an offshore sea island connected to shore by a subsea gas pipeline, such as pipeline 270 as illustrated in FIG. 2B. In certain embodiments, dock 200 may be a sea island offshore in water depths up to about 65 feet, depending upon meteorological and oceanographic ("metocean") and geotechnical conditions, and connected to shoreline 210 by pipeline 270, which pipeline 270 may be wholly or partially located on shoreline 210, dock 200 and/or the ocean floor.

In some embodiments, gas conduit 320, for example a gas pipeline, may extend from an offshore gas reserve and/or a land-based gas reserve to onshore pretreatment facility 280. Onshore pretreatment facility 280 may be proximate dock 200 and/or at an onshore location capable of connection to dock 200 by pipeline. Prior to being injected into gas conduit 320, produced gas may first be treated at a treatment facility to bring the produced gas to pipeline quality. Gas conduit 320 may be one or more pipelines, a system of pipelines and/or a header pipeline carrying pipeline quality natural gas to onshore pretreatment facility 280 to allow gathered gas to be pretreated for liquefaction. Onshore pretreatment facility 280 may compress and/or process the pipeline-quality natural gas such that it is brought to near-LNG quality. The pretreated gas may then be transported through pipeline 270 to floating liquefaction unit 100 for final gas processing and/or liquefaction. In some embodiments, final gas processing to bring the near-LNG quality, pretreated gas to LNG quality may take place onboard floating liquefaction unit 100. In some embodiments, the natural gas may be brought to LNG quality at onshore pretreatment facility 280. LNG quality natural gas may be natural gas ready for liquefaction and/or which has had lighter components that tend to freeze removed.

Pipeline 270, may extend along the ocean floor and onto a sea island embodiment of dock 200, as depicted in FIG. 2B. In some embodiments, pipeline 270 may extend onshore and along dock 200, as depicted in FIG. 2A. The location of pipeline 270 may depend upon the location of onshore pretreatment facility 280 in relation to dock 200. In other embodiments, gas pretreatment may take place onboard floating liquefaction unit 100 and pipeline quality gas may be transported from the reserve directly to liquefaction unit 100 for pretreatment and liquefaction. Use of gas conduit 320 and/or pipeline 270 to transport gas to onshore pretreatment facility 280 and/or floating liquefaction unit 100 eliminates the need for subsea buoy systems, for example a submerged turret-loading system, and reduces the need for expensive and difficult-to-construct subsea infrastructure.

Dock 200 may include mobile access roads to provide mobile cranes with points of ingress and egress to and/or from floating liquefaction unit 100. In some embodiments, the ship channel may have been previously dredged to accommodate delivery of floating liquefaction unit 100 through shipping lane 235 (shown in FIG. 2A), and to create berth 240 (shown in FIG. 2A) for floating liquefaction unit 100, in addition to a berth and turning basin 245 (shown in FIG. 2A) for traditional LNG carrier 250 which may receive LNG from floating liquefaction unit 100. In some embodiments, berth 240 may be concrete matted.

Floating liquefaction unit 100 may be moored to dock 200 and/or shoreline 210. In some embodiments, floating liquefaction unit 100 may be moored to shoreline 210 and/or dock 200 utilizing mooring line 220 attached to deadman anchor 230, such that floating liquefaction unit 100 may remain at dock 200 through severe weather events, such as storms, hurricanes and strong currents. Floating liquefaction unit 100 may employ a two-stage mooring system implementing ground anchors and capable of withstanding 100 year storm criteria such as a 17 foot tidal surge. In some embodiments, suitable and sufficient mooring lines 200 may be connected to deadman anchors 230. The configuration and number of mooring lines may depend upon the strength, type and/or diameter of the lines. Fenders 260 may assist in absorbing kinetic energy of floating liquefaction unit 100 and preventing damage to floating liquefaction unit 100 while moored at dock 200.

High pressure gas arm 330 may receive natural gas from pipeline 270 on dock 200 and transfer near LNG-quality or LNG quality gas to floating liquefaction unit 100. In alternative embodiments, high pressure gas arm may receive pipeline quality natural gas from gas conduit 320 on dock 200 and transfer the pipeline quality gas to floating liquefaction unit 100. High pressure gas arm may be designed to handle the high pressure nature gas that may be discharged from pipeline 270 and/or gas conduit 320. The Emco Wheaton Division of the Engineered Products Group of Gardner Denver, Inc. of Quincy, Ill. or FMC Technologies of France provide exemplary high pressure gas arms. High pressure gas arm 330 may deliver natural gas directly to liquefaction module 110 onboard floating liquefaction unit 100, to fractionation system 135 onboard floating liquefaction unit 100 or to gas processing facilities onboard floating liquefaction unit 100. In some embodiments, high pressure gas arm 330 transfers natural gas to gas process area 290, which in some embodiments may be onshore as illustrated in FIGS. 2A and 2B, or alternatively may be onboard floating liquefaction unit 100. High pressure gas arm 330 may be a hard marine loading arm.

Pipeline 270 may transport pretreated natural gas to floating liquefaction unit 100 from onshore pretreatment facilities 280. Onshore pretreatment facilities 280 may allow floating liquefaction unit 100 to be more compact in size, lower density and/or have more space on deck 115 for liquefaction module 110, for example about 25% more space. As shown in FIGS. 2A and 2B, onshore pretreatment facilities 280 may include gas receiving area 305, and spiking facilities (not shown), waste water treatment area 295, gas process area 290, cooling water heat exchangers 310 and associated equipment for both the onshore and the floating liquefaction unit equipment, water storage tank 315, office 300 and/or hydrocarbon condensate storage area 285. Hydrocarbon condensate storage area 285, which may be onshore, may receive and store onshore condensate from the fractionation system 135, which fractionation system may be located onboard floating liquefaction unit 100.

Figure 3:
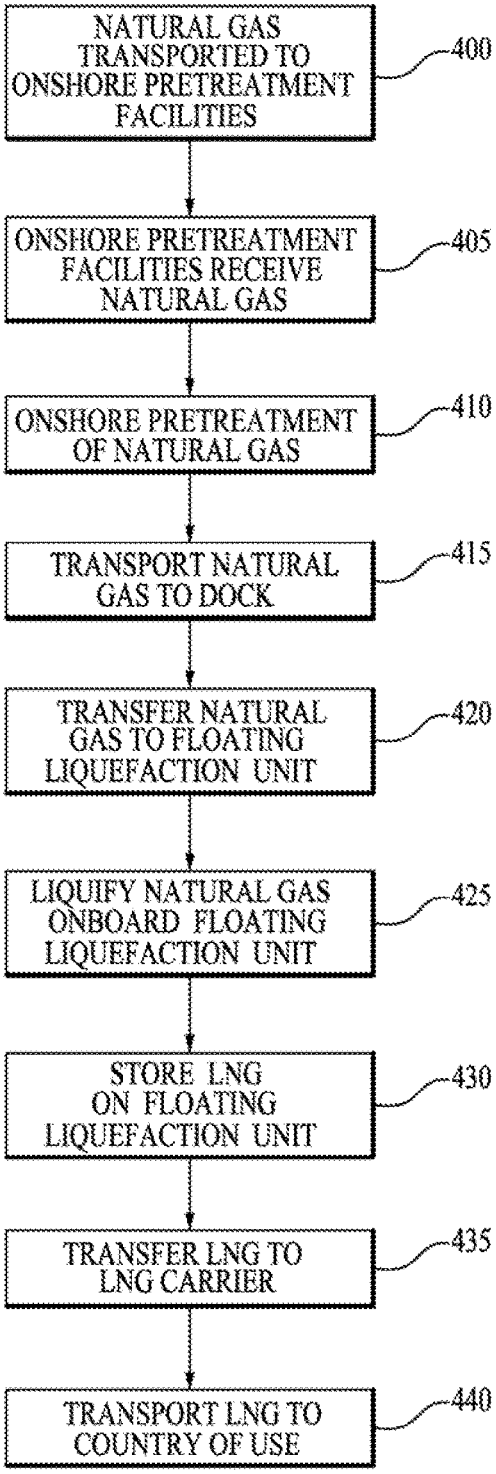
FIG. 3 is a flow chart illustrating an exemplary method of onshore pretreatment and floating dockside liquefaction of natural gas of an illustrative embodiment.

FIG. 3 is a flow chart illustrating an exemplary method for floating dockside liquefaction of natural gas. At step 400, pipeline quality natural gas may be transported to onshore pretreatment facilities 280 through gas conduit 320. Pretreatment facilities 280 may receive natural gas at receiving area 305 at step 405. At step 410, natural gas is pretreated at onshore gas process area 290 for removal of carbon dioxide, hydrogen sulfide, water, mercury and/or other impurities. Also at step 410, the gas may be dehydrated and the removed water may be treated and/or the gas may be compressed. Pretreated gas of near LNG quality or LNG quality may then travel through pipeline 270 onto dock 200 at step 415, and may then be transferred onto floating liquefaction unit 100, liquefaction module 110 and/or fractionation system 135 with high pressure gas arm 330 at step 420. In some embodiments, pretreatment facilities 280 may be located onboard liquefaction unit 100 and natural gas may be transported directly from conduit 320 to dock 200, and then to pretreatment facilities 280 onboard liquefaction unit 100. The location of production may be onshore and/or offshore.

Once onboard floating liquefaction unit 100, natural gas may be liquefied by liquefaction module 110 at step 425 using liquefaction methods known by those of skill in the art. In embodiments where near-LNG quality gas is transferred onto floating liquefaction unit 100, step 425 may include final processing to bring the natural gas to LNG quality prior to liquefaction. Once the gas is liquefied, the resulting LNG may then be transferred to LNG storage tank 120 at step 430, and from LNG storage tank 120 to LNG carrier 250 at step 435.

In some embodiments, the LNG may be transferred from storage tank 120 onboard floating liquefaction unit 100 to cryogenic LNG cargo tanks onboard LNG carrier 250. Cryogenic LNG cargo tank(s) onboard LNG carrier 250 may be membrane, self-supporting prismatic or self-supporting spherical type cargo tanks and are well known to those of skill in the art. In some embodiments cryogenic LNG cargo tanks may be similar to LNG storage tank 120 onboard floating liquefaction unit 100. LNG carrier 250 may be moored in front of, behind, or next to floating liquefaction unit 100 in a side-by-side or tandem configuration, moored across the dock from floating liquefaction unit 100 or moored at dock 200 next to floating liquefaction unit 100. Ship-to-ship transfer, utilizing hose 325, may be employed to transfer the LNG from floating liquefaction unit LNG storage tank 120 to LNG carrier 250. In some embodiments, hose 325 may be a cryogenic marine hard loading arm. In some embodiments, hose 325 may be an unloading hard arm. In some embodiments, hose 325 is a cryogenic flexible hose. In some embodiments, LNG carrier 250 may be a regasification vessel, equipped with an onboard LNG regasification unit. In certain embodiments, LNG carrier 250 may have the capacity to re-liquefy boil-off gas. At step 440, LNG carrier 250 may transport the LNG liquefied onboard floating liquefaction unit 100 to the country of use and/or to another LNG carrier vessel.

The systems and methods of the invention may allow a compact floating liquefaction unit, including all liquefaction train(s), capable of producing up to 5 MTPA of LNG, to be fully constructed in a shipyard within about 44 months from a final investment decision. Shipyard construction of the unit may be made at a reduced cost as compared to land based construction methods which must be completed at the location of liquefaction where it is more difficult to obtain materials and/or specialized labor, or as compared to the construction of much larger fully-integrated floating units. Illustrative embodiments of the invention efficiently bifurcate pretreatment, liquefaction and associated systems between onshore and offshore facilities and may allow small and/or stranded reserves of natural gas to be collected and utilized in a cost efficient manner with flexibility to respond to varying locations of gas reserves.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims. In addition, it is to be understood that features described herein independently may, in certain embodiments, be combined.

What is claimed is:

1. A system for floating dockside liquefaction of natural gas comprising:

a floating liquefaction unit moored at a sea island, wherein the floating liquefaction unit further comprises a natural gas liquefaction module and an LNG storage tank that stores produced LNG;

a natural gas pretreatment facility located onshore proximate the sea island, the onshore natural gas pretreatment facility comprising storage for condensate removed from natural gas onboard the floating liquefaction unit;

a pipeline extending at least partially below a surface of a water that transports pretreated natural gas from the onshore pretreatment facility to the sea island; and a natural gas conduit that delivers pipeline quality natural gas to the onshore pretreatment facility.

2. The system of claim 1, further comprising an LNG carrier that receives LNG from the LNG storage tank onboard the floating liquefaction unit.

3. The system of claim 2, wherein the LNG carrier is moored at the sea island.

4. The system of claim 2, wherein the LNG carrier is moored side-by-side with the floating liquefaction unit.

5. The system of claim 2, wherein the receiving LNG carrier receives LNG from the floating liquefaction unit using across-the-sea island ship-to-ship transfer of LNG.

6. The system of claim 1, wherein the pipeline is at least partially on the sea island.

7. The system of claim 1, wherein the onshore natural gas pretreatment facility comprises facilities that remove impurities from the natural gas.

8. A system for floating dockside liquefaction of natural gas comprising:

a floating liquefaction unit moored at a sea island, wherein the floating liquefaction unit further comprises a natural gas liquefaction module and an LNG storage tank for storing produced LNG;

a natural gas pretreatment facility located onshore proximate the sea island, the onshore natural gas pretreatment facility comprising a closed loop cooling system that cools equipment onboard the floating liquefaction unit;

a pipeline extending at least partially below a surface of a water that transports pretreated natural gas from the onshore pretreatment facility to the sea island; and a natural gas conduit that delivers pipeline quality natural gas to the onshore pretreatment facility.

9. The system of claim 8, wherein the closed loop cooling system further comprises an onshore cooling water heat exchanger and flexible connections to an aft and forward of the floating liquefaction unit.

10. The system of claim 8, further comprising a fractionation system located on the floating liquefaction unit, wherein associated condensate storage is located at the onshore pretreatment facility.

11. The system of claim 8, wherein the onshore natural gas pretreatment facility comprises storage for condensate removed from natural gas onboard the floating liquefaction unit.

12. A method for floating dockside liquefaction of natural gas, comprising:

pretreating natural gas for shipboard liquefaction at an onshore pretreatment facility proximate a dock;

transporting the pretreated natural gas by pipeline from the onshore pretreatment facility to a floating liquefaction unit moored at the dock;

liquefying the natural gas onboard the floating liquefaction unit to form LNG;

storing the LNG onboard the floating liquefaction unit;

transferring the LNG from the floating liquefaction unit to a receiving LNG carrier for transport to the location of use;

and cooling liquefaction machine drivers onboard the floating liquefaction unit using an onshore cooling water heat exchanger.

13. The method of claim 12, further comprising removing condensate from the natural gas onboard the floating liquefaction unit and subsequently transferring the condensate to an onshore storage facility located proximate the dock for storage.

14. The method of claim 12, wherein the LNG is transferred from the floating liquefaction unit to a receiving LNG carrier using side-by-side ship-to-ship transfer.

15. The method of claim 12, wherein the floating liquefaction unit is moored at the dock with mooring lines to deadmen anchors located onshore.

16. The method of claim 12, further comprising completing construction of the floating liquefaction unit at a shipyard and transporting the fully constructed floating liquefaction unit from the shipyard to the dock.

17. The method of claim 12, wherein the dock is a sea island.

18. The method of claim 17, wherein the natural gas is transported to the floating liquefaction unit at least partially beneath the surface of a water and at least partially on the sea island.

19. The method of claim 12, wherein the pipeline extends at least partially along the dock.

20. The method of claim 12, further comprising cooling liquefaction systems onboard the floating liquefaction unit using shore-based water.

* * * * *